US008915574B2

(12) United States Patent
Sato

(10) Patent No.: US 8,915,574 B2
(45) Date of Patent: Dec. 23, 2014

(54) PRINTING DEVICE AND METHOD FOR CONTROLLING PRINTING DEVICE

(71) Applicant: Seiko Epson Corporation, Tokyo (JP)

(72) Inventor: Akito Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/140,110

(22) Filed: Dec. 24, 2013

(65) Prior Publication Data

US 2014/0240382 A1 Aug. 28, 2014

(30) Foreign Application Priority Data

Feb. 22, 2013 (JP) ..... 2013-032943

(51) Int. Cl.
*B41J 3/60* (2006.01)
*B41J 2/07* (2006.01)
*B41J 2/165* (2006.01)

(52) U.S. Cl.
CPC ..... *B41J 2/07* (2013.01); *B41J 2002/16529* (2013.01); *B41J 3/60* (2013.01)
USPC ..... 347/35

(58) Field of Classification Search
CPC ..... B41J 2002/16529; B41J 3/60
See application file for complete search history.

(56) References Cited

U.S. PATENT DOCUMENTS 7,185,962 B2 * 3/2007 Takahashi et al. ..... 347/14
7,548,316 B2 * 6/2009 Castillo et al. ..... 356/406
7,686,295 B2 * 3/2010 Kawaguchi et al. ..... 271/188
7,813,689 B2 * 10/2010 Nakamura et al. ..... 399/340
8,029,126 B2 * 10/2011 Imoto ..... 347/104
8,757,909 B2 * 6/2014 Yasuzaki ..... 400/583
2010/0271415 A1 * 10/2010 Sakagami ..... 347/16
2012/0199026 A1 * 8/2012 Naka et al. ..... 101/416.1
2013/0100222 A1 * 4/2013 Nieda et al. ..... 347/104

FOREIGN PATENT DOCUMENTS

JP 07-314708 A 12/1995
JP 2010-089464 A 4/2010

* cited by examiner

*Primary Examiner* — Julian Huffman
(74) *Attorney, Agent, or Firm* — Global IP Counselors, LLP

(57) ABSTRACT

A printing device includes a head that has a plurality of nozzles, a reversing section for reversing a front surface and a back surface that are facing surfaces of a printing medium facing the head, and a control section for causing the head to execute an ejection operation of forming an image forming dot for printing an image designated as a print target and a flushing dot other than the image forming dot on the facing surface by moving either one of the printing medium and the head so as to relatively change the positions of the printing medium and the head and ejecting liquid from each of the nozzles. The control section calculates a liquid amount of the liquid ejected onto each of the two facing surfaces of the printing medium so as to form the image forming dot, predicts occurrence of warpage due to a curl phenomenon in which warpage of the printing medium occurs in one direction by absorbing the ejected liquid based on the liquid amount, and controls the ejection operation of forming the flushing dot such that a difference in the liquid amounts ejected onto the two facing surfaces is equal to or less than a prescribed amount.

7 Claims, 6 Drawing Sheets

PRINTING DEVICE AND METHOD FOR CONTROLLING PRINTING DEVICE

CROSS-REFERENCE TO RELATED APPLICATIONS

This application claims priority to Japanese Patent Application No. 2013-032943 filed on Feb. 22, 2013. The entire disclosure of Japanese Patent Application No. 2013-032943 is hereby incorporated herein by reference.

BACKGROUND

1. Technical Field

The present invention relates to a printing device and a method for controlling a printing device.

2. Background Technology

An inkjet printer is known in which printing is conducted by feeding paper in one direction, moving a head having a plurality of nozzles back and forth in another direction perpendicular to the one direction, and ejecting ink from each of the nozzles. In the inkjet printer, when a state in which ink is not ejected from the nozzles lasts, there are cases in which the moisture of ink evaporates from the openings of the nozzles so as to increase the viscosity of ink. When the viscosity of ink is increased, there are cases in which clogging of the nozzles occurs and the ejection operation of ink becomes unstable. In order to avoid these situations, as shown in Patent Document 1, for example, an apparatus has been proposed in which a flushing process of ejecting ink from each of nozzles is conducted to a margin area or the like of paper so as to prevent or solve clogging of the nozzles. Also, there are a lot of devices in which a double-sided printing mechanism is installed so as to conduct printing on both sides of paper. For example, an inkjet printer is known in which a recording head and a paper reversing mechanism are installed. This inkjet printer reverses a front surface and a back surface of printing paper by causing the printing paper to pass through a prescribed feed path after conducting printing to one of the surfaces of the printing paper by the head, and then conducts printing to the other of the surfaces by the same head. Generally, it is known that a phenomenon of warpage in which a surface of paper rises (hereinafter, referred to as a "curl phenomenon") occurs because one of the surfaces of paper swells by absorbing ink when ink adheres to the surface of the paper while areas other than the surface do not easily swell. There is a possibility that paper in which such a curl phenomenon has occurred will contact members inside the printer while being fed inside the printer, and there is concern that it will affect the print quality (abrasion, dirt, paper crease, and the like).

Japanese Laid-open Patent Publication No. H7-314708 (Patent Document 1) is an example of the related art.

SUMMARY

Problems to Be Solved by the Invention

Therefore, a technique for controlling the occurrence of warpage has been desired in which the amount of ink adhering to each of two surfaces of paper is adjusted by a flushing process when warpage due to a curl phenomenon might occur in one of the two surfaces of the paper. However, no technique or device that controls the occurrence of warpage due to a curl phenomenon by adjusting the amount of ink adhering to paper by a flushing process has been disclosed. The advantage of the invention is to prevent or solve clogging of a nozzle and control the occurrence of warpage due to a curl phenomenon in paper by conducting a flushing process to the paper.

Means Used to Solve the Above-Mentioned Problems

The invention has been made to address at least part of the above-described circumstances, and the invention can be implemented as the following embodiment or application examples.

APPLICATION EXAMPLE 1

According to the present application example, a printing device includes a head that has a plurality of nozzles, a reversing section for reversing a front surface and a back surface that are facing surfaces of a printing medium facing the head, and a control section for causing the head to execute an ejection operation of forming an image forming dot for printing an image designated as a print target and a flushing dot other than the image forming dot on the facing surface by moving either one of the printing medium and the head so as to relatively change the positions of the printing medium and the head and ejecting liquid from each of the nozzles. The control section calculates a liquid amount of the liquid ejected onto each of the two facing surfaces of the printing medium so as to form the image forming dot, predicts occurrence of warpage due to a curl phenomenon in which warpage of the printing medium occurs in one direction by absorbing the ejected liquid based on the liquid amount, and controls the ejection operation of forming the flushing dot such that a difference in the liquid amounts ejected onto the two facing surfaces is equal to or less than a prescribed amount.

With this configuration, the occurrence of warpage due to a curl phenomenon is predicted based on the liquid amount ejected onto each of the facing surfaces of the printing medium to print a print image, and the ejection operation of forming the flushing dot is controlled such that a difference in the liquid amounts ejected onto the two facing surfaces is equal to or less than a prescribed amount. Accordingly, by forming the flushing dot of the determined ejection amount on the printing medium, clogging of the nozzles can be prevented or solved, and in addition, the expected occurrence of warpage due to a curl phenomenon can be controlled.

APPLICATION EXAMPLE 2

Preferably, the printing device according to the above-described application example has a determining means that determines whether occurrence of the warpage is to be controlled or not, and in a case in which the determining means determines that occurrence of the warpage is to be controlled, the control section determines the liquid amount ejected for the flushing dot onto at least one of the two facing surfaces.

With this configuration, in a case in which it is determined that warpage is to be controlled, ejection data of flushing that does not cause warpage is generated. Therefore, the occurrence of warpage in the printing medium can be controlled.

APPLICATION EXAMPLE 3

Preferably, in the printing device according to the above-described application example, the determining means has a direction determining means that determines a direction of causing the warpage in the printing medium in a case in which it is determined that occurrence of the warpage is not to be controlled, and the control section determines the liquid amount such that wapage occurs in the direction determined by the direction determining means.

With this configuration, in a case in which the direction of causing the warpage in the printing medium is determined, ejection data of flushing that causes warpage in the determined direction is generated. Therefore, the direction of the warpage of the printing medium due to a curl phenomenon can be controlled.

APPLICATION EXAMPLE 4

Preferably, in the printing device according to the above-described application example, the control section predicts occurrence of the warpage based on an ejection distribution state of the liquid, the kind of the liquid, or the kind of the printing medium in addition to the liquid amount ejected onto the printing medium.

With this configuration, the accuracy of predicting occurrence of a curl phenomenon can be improved.

APPLICATION EXAMPLE 5

In the printing device according to the above-described application example, the control section causes the flushing dot to be formed with a prescribed amount of the liquid amount and a prescribed dot pattern on one surface of the printing medium, and causes the flushing dot to be formed with the liquid amount and a dot pattern determined to control occurrence of the warpage on the other surface of the printing medium.

APPLICATION EXAMPLE 6

According to the present application example, a printing device includes a head that has a plurality of nozzles, a reversing section for reversing a front surface and a back surface that are facing surfaces of a printing medium facing the head, and a control section for causing the head to execute an ejection operation of forming an image forming dot for printing an image designated as a print target and a flushing dot other than the image forming dot on the facing surface based on ejection data by moving either one of the printing medium and the head so as to relatively change the positions of the printing medium and the head and ejecting liquid from each of the nozzles. The control section has a predicting means that calculates a liquid amount ejected onto each of the two facing surfaces of the printing medium so as to form the image forming dot and predicts occurrence of warpage due to a curl phenomenon in which warpage of the printing medium occurs in one direction by absorbing the ejected liquid based on the liquid amount, a curl occurrence control means that controls occurrence of the warpage predicted by the predicting means, and a generating means that generates the ejection data that forms the flushing dot for controlling occurrence of the warpage on at least one of the facing surfaces.

With this configuration, the occurrence of warpage due to a curl phenomenon is predicted based on the liquid amount ejected onto each of the facing surfaces of the printing medium to print a print image, and the ejection data that forms the flushing dot for controlling the predicted occurrence of the warpage is generated. Accordingly, by forming the flushing dot on the printing medium based on the generated ejection data, clogging of the nozzles can be prevented or solved, and in addition, the expected occurrence of warpage due to a curl phenomenon, that is expected to occur by printing an image of a print target onto the printing medium, can be controlled.

APPLICATION EXAMPLE 7

According to the present application example, a method for controlling a printing device is a method for controlling a printing device including a head that has a plurality of nozzles, a reversing section for reversing a front surface and a back surface that are facing surfaces of a printing medium facing the head, and a control section for causing the head to execute an ejection operation of forming an image forming dot for printing an image designated as a print target and a flushing dot other than the image forming dot on the facing surface based on ejection data by moving either one of the printing medium and the head so as to relatively change the positions of the printing medium and the head and ejecting liquid from each of the nozzles. The method includes a predicting step that calculates a liquid amount ejected onto each of the two facing surfaces of the printing medium so as to form the image forming dot and predicts occurrence of warpage due to a curl phenomenon in which warpage of the printing medium occurs in one direction by absorbing the ejected liquid based on the liquid amount, a curl occurrence control step that controls occurrence of the warpage predicted by the predicting means, and a generating step that generates the ejection data that forms the flushing dot for controlling occurrence of the warpage on at least one of the facing surfaces.

With this method, the occurrence of warpage due to a curl phenomenon is predicted based on the liquid amount ejected onto each of the facing surfaces of the printing medium to print a print image, and the ejection data that forms the flushing dot for controlling the predicted occurrence of the warpage is generated. Accordingly, by forming the flushing dot on the printing medium based on the generated ejection data, clogging of the nozzles can be prevented or solved, and in addition, the expected occurrence of warpage due to a curl phenomenon, that is expected to occur by printing an image of a print target onto the printing medium, can be controlled.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, an embodiment of the invention will be explained with reference to the drawings.

(Embodiment)

Figure 1:
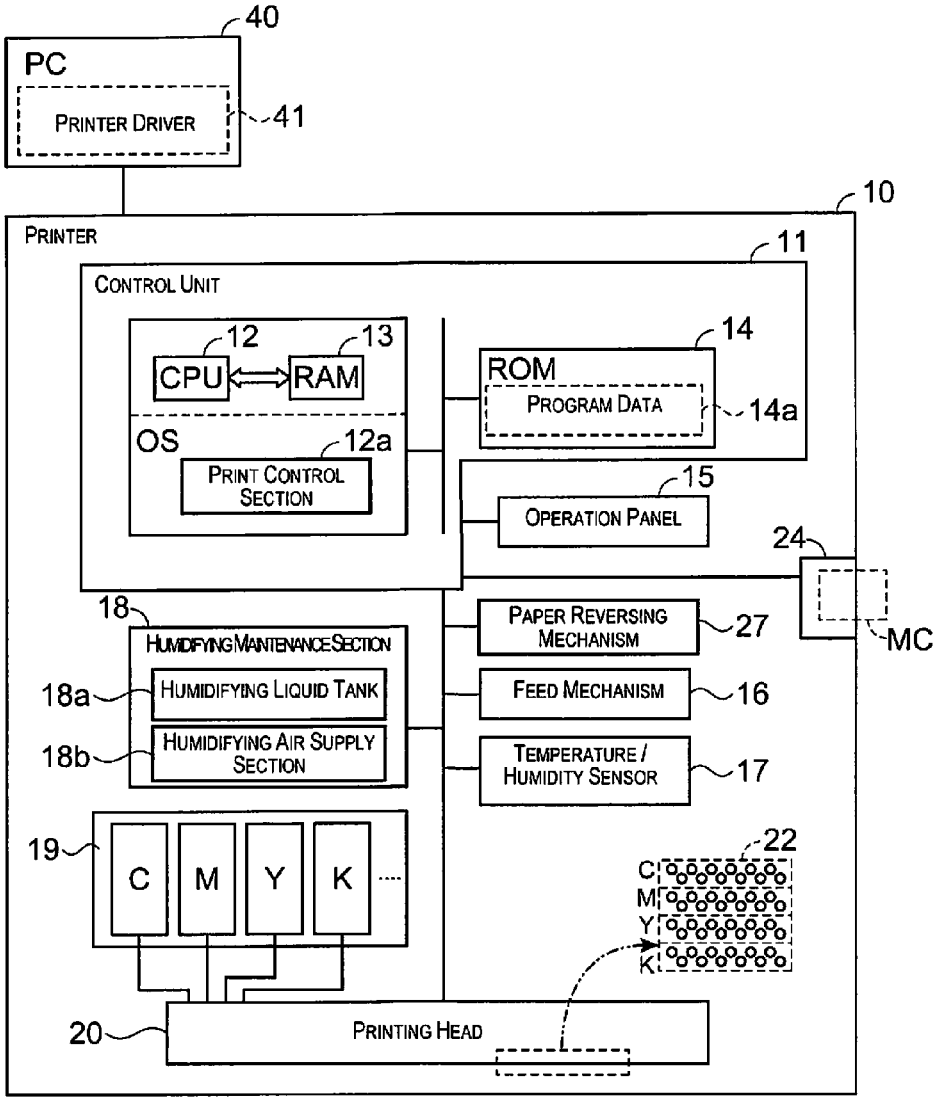
FIG. 1 is a diagram that schematically shows a hardware configuration and a software configuration of a printer according to an embodiment of the invention.

Hereinafter, the embodiment of the invention will be explained with reference to the drawings. FIG. 1 schematically shows a hardware configuration and a software configuration of a personal computer (PC) 40 and a printer 10. The printer 10 corresponds to a printing device. However, a system that includes the PC 40 and printer 10 can be considered as the printing device. The printer 10 has a control unit 11 for controlling a liquid ejection process (print process). In the control unit 11, a CPU 12 opens program data 14*a* such as firmware stored in a memory such as a ROM 14 in a RAM 13 and conducts calculation in accordance with the program data 14*a* under an OS, so as to control each function of a print control section 12*a* or the like.

The print control section 12*a* inputs image data from a storage medium or the like inserted from outside into the PC 40 or the printer 10, for example, and generates print data from the image data. Then, printing can be conducted based on the print data. For example, a memory card MC is conceived as the storage medium. This memory card MC is inserted into a slot portion 24 that is formed in a case body of the printer 10. The print control section 12*a* can input image data from various external devices such as a scanner connected to the printer 10 in a wired or wireless manner, a digital still camera, a cell phone terminal, or a server connected via a network. The image data shows an image (print target image) that a user arbitrarily designates as a print target. For example, the image data is bit map data, RGB data that has tones of a color system of red, green, and blue (R, G, and B) for each pixel, or ink amount data that has tones of an ink color system (cyan (C), magenta (M), yellow (Y), black (K), and the like) used by the printer 10 for each pixel. The control section 12*a* conducts a resolution conversion process, a conversion process of the color system (color conversion process), a halftone process, or the like to the bit map data, so as to generate print data. The print data is data for each kind of ink in which ejection (dot on) and non-ejection (dot off) of liquid (ink) is specified for each pixel.

The print control section 12*a* receives print data generated from image data by a printer driver 41 from the PC 40 so as to conduct printing based on the received print data. The printer driver 41 is installed in the PC 40. Alternatively, the print control section 12*a* receives PDL data expressed by a prescribed page description language (PDL) from the printer driver 41 so as to conduct printing of a print target image based on the PDL data. In this case, the print control section 12*a* converts the PDL data into an intermediate code by analyzing the PDL data, and generates bit map data on the RAM 13 by opening the intermediate code. The print control section 12*a* generates print data from the bit map data.

This printer 10 has a cartridge 19 for each of a plurality of kinds of liquid. In the example of FIG. 1, the cartridge 19 is installed corresponding to each ink of CMYK. However, the specific kind or number of the liquid used by the printer 10 is not limited. For example, various kinds of ink such as light cyan, light magenta, orange, green, gray, light gray, white, metallic ink, or precoat liquid or the like that is a chemical solution for causing aggregation or deposit of a coloring component of each ink can be used. Also, the printer 10 has a printing head 20 for selectively ejecting (injecting liquid), supplied from each cartridge 19, from a great number of nozzles 22 for liquid ejection. The printing head 20 in the present embodiment is a so-called line head that has an elongated shape. Incidentally, FIG. 1 shows the position of the nozzles 22 in the printing head 20, but does not show the arrangement configuration of the nozzles 22. According to the present embodiment, in the printing head 20, a nozzle line is formed by arranging a plurality of short heads in a zigzag pattern and providing the nozzles 22 in each head. However, the arrangement of the nozzle line is not limited. The arrangement of the nozzles 22 for each color can be configured as a plurality of nozzle lines that are displaced in a longitudinal direction with a prescribed pitch as shown in FIG. 1, or can be configured as a single nozzle line lined up along the longitudinal direction.

The print control section 12*a* generates a driving signal for driving the printing head 20, a paper reversing mechanism 27, a feed mechanism 16, or the like based on the print data. A piezoelectric element is provided for each nozzle 22 in the printing head 20 so as to eject liquid drops (dots from the nozzle 22). The piezoelectric element is deformed when the driving signal is applied, and causes dots to be ejected from the corresponding nozzle 22. The feed mechanism 16 has a motor (not shown in the drawings), rollers 16*a*, 16*b*, and 16*c* (see FIG. 2) that rotate by the motor, and the like. The feed mechanism 16 feeds a printing medium along a prescribed feed direction by driving control using the print control section 12*a*. When ink is ejected from each nozzle 22 of the printing head 20 to the printing medium that has reached a prescribed feed position, dots adhere onto the printing medium under feeding, and a print target image is reproduced on the printing medium based on the print data. Here, although paper P is conceived as the printing medium in the present embodiment, the printing medium is not limited to paper.

The paper reversing mechanism 27 has a motor and a roller that are not shown in the drawings, and serves as a reversing section for reversing a front surface and a back surface of the paper P. In a case in which the print data instructs printing on both surfaces of the paper P, the paper reversing mechanism 27 reverses the front surface and the back surface of the paper P based on the instructions of the print control section 12*a*. In the present embodiment, the paper reversing mechanism 27 reverses the front surface and the back surface by sandwiching the paper P, that has undergone ejection of liquid such as ink onto one of facing surfaces of the paper P facing the printing head 20 and has been fed by the feed mechanism 16, with a rotating roller and moving the paper P in a prescribed feed path. The paper P whose front and back surfaces are reversed is fed to the prescribed feed position again by the feed mechanism 16, and liquid such as ink is ejected from the printing head 20 onto the other of the facing surfaces facing the printing head 20. As a result of this, a print target image is reproduced on both surfaces of the paper P, respectively. In the following explanations, one of the facing surfaces to which printing to the paper P is conducted first is referred to as the front surface, and the other of the facing surfaces to which printing is conducted after reversing the paper P is referred to as the back surface. The printer 10 has an operation panel 15. The operation panel 15 includes a display section (for example, a liquid crystal panel), a touch panel, various kinds of buttons, and keys. The touch panel, the buttons, and the keys are formed on the display section. The operation panel 15 displays a user interface (UI) screen on the display section or receives input of the printing conditions or the like from a user. The printing conditions can include the kind of the paper P, the direction of the printing, the layout with respect to the paper P, the print resolution, the necessity of double-sided printing, curl control to the paper P, and the like.

In addition to a print operation from the operation panel 15, it is also possible to cause the printer 10 to print a print target image by operating the PC 40. A user inputs print instructions or printing conditions of a print target image through a UI screen presented by the printer driver 41 on a display of the PC 40. Also, the information showing the printing conditions that has been input in this manner is transmitted from the PC 40 to the printer 10 together with the print data. Also, the printer 10 has a temperature/humidity sensor 17 that acquires temperature or humidity, and a humidifying maintenance section 18. The humidifying maintenance section 18 has a humidifying liquid tank 18*a* for storing humidifying liquid that includes a non-volatile component, and a humidifying air supply section 18*b* for supplying air, humidified by the humidifying liquid stored in the humidifying liquid tank 18*a*, to a sealed space facing an opening of the nozzle 22. The humidifying maintenance section 18 controls increase in the viscosity of the ink in the nozzle 22.

Figure 2:
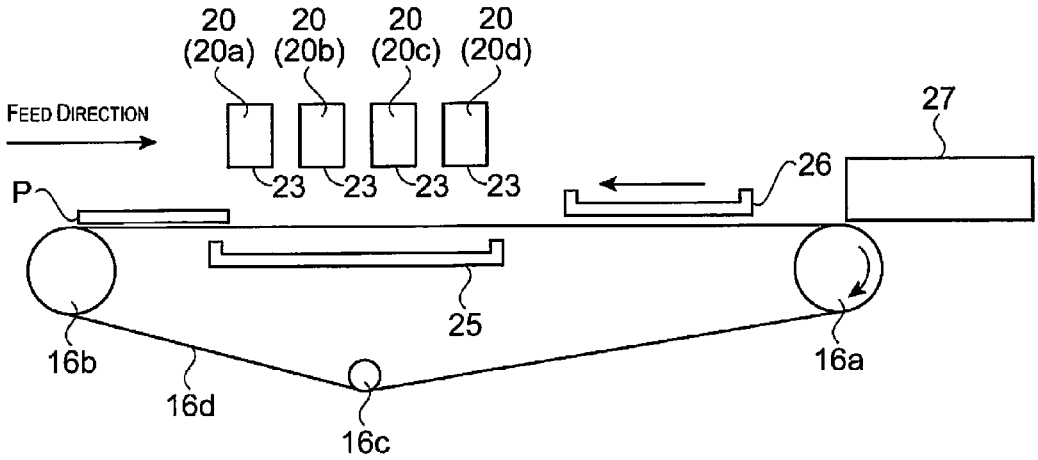
FIG. 2 is a diagram that illustrates a part of an internal configuration of the printer according to the embodiment of the invention in a simplified manner.

FIG. 2 illustrates a part of an internal configuration of the printer 10 in a simplified manner from view in the longitudinal direction of the printing head 20. The printing head 20 has a plurality of line heads 20*a*, 20*b*, 20*c*, and 20*d* for each kind of ink. The line heads 20*a*, 20*b*, 20*c*, and 20*d* have the same configuration. For example, the line head 20*a* can execute ejection of C ink, the line head 20*b* can execute ejection of M ink, the line head 20*c* can execute ejection of Y ink, and the line head 20*d* can execute ejection of K ink, respectively. The line heads 20*a*, 20*b*, 20*c*, and 20*d* are fixed in prescribed positions in the printer 10, for example, in a state in which the line heads 20*a*, 20*b*, 20*c*, and 20*d* are in parallel with each other in the longitudinal direction. Hereinafter, the "longitudinal direction" always refers to a longitudinal direction of each of the line heads 20*a*, 20*b*, 20*c*, and 20*d* unless it is described otherwise.

As shown in FIG. 2, an endless belt 16*d* that moves by being caught with the rotating rollers 16*a*, 16*b*, and 16*c* is provided in a position opposed to a nozzle opening surface 23 as the feed mechanism 16. The paper P is fed in a feed direction by being placed on the endless belt 16*d*, and undergoes ejection of ink from the nozzle 22 when passing below the nozzle opening surface 23. The longitudinal direction of the line heads 20*a*, 20*b*, 20*c*, and 20*d* is a direction that intersects with the feed direction of the paper P, and the line heads 20*a*, 20*b*, 20*c*, and 20*d* are arranged at prescribed intervals in the feed direction. "Intersection" described herein refers to perpendicular intersection. However, perpendicular intersection described in the present specification does not mean an exact angle (90°) alone, and includes an error of the angle to an extent that is accepted in terms of the quality of the product.

In the present embodiment, mainly, the explanation is continued based on an assumption that the printing head 20 is fixed and the paper P is fed by the feed mechanism 16. However, it can be configured such that the printing head 20 moves by a carriage with respect to the paper P that does not move (or temporarily stops moving). Specifically, it is sufficient that at least one of the paper P and the printing head 20 moves and the positions of the paper P and the printing head 20 relatively change along a prescribed direction. In the case of moving the printing head 20, the longitudinal direction is a direction that intersects with the direction for relatively changing the positions of the paper P and the printing head 20. The printing head 20 is not limited to the line head. Specifically, another embodiment is possible in which printing is conducted by moving the head back and forth in a scanning direction perpendicular to the feed direction (sub scanning direction) of the paper P.

In the present embodiment, the printer 10 can execute flushing. Flushing refers to a specific operation for forming dots other than dots for printing a print target image by ejecting ink from the nozzles 22 so as to control increase in the viscosity of ink in the printing head 20. Dots for printing a print target image (dots constituting print data) can be called as image forming dots, and dots other than the image forming dots can be called as flushing dots. Here, ink drops by the flushing dots have very small volumes. Therefore, even if the ink drops land on the paper P, the ink drops cannot be observed with the naked eye.

Flushing includes "first flushing" that conducts ink ejection to a place other than the paper P, and "second flushing" that conducts ink ejection to the paper P. The first flushing uses, for example, a waste solution cap 26. The waste solution cap 26 moves to below the nozzle opening surface 23 so as to cover the nozzle opening surface 23 at a timing of execution of the first flushing in response to control by the control unit 11. The printing head 20 ejects ink from each nozzle 22 as the first flushing in a state where the nozzle opening surface 23 is covered with the waste solution cap 26. Ink ejected in this manner is stored in the waste solution cap 26. The waste solution cap 26 returns to a prescribed original position after completion of the first flushing in response to control by the control unit 11.

Also, as an example of the first flushing, the printer 10 can conduct flushing to the endless belt 16*d*. In this case, a waste solution saucer 25 for receiving a waste solution is provided in a position that is opposed to the nozzle opening surface 23 in a state in which the endless belt 16*d* is sandwiched. For example, the endless belt 16*d* can be formed in a mesh shape such that ink ejected onto the belt surface can pass therethrough. As the first flushing, the printing head 20 ejects ink from each nozzle 22 at a prescribed timing when the paper P does not exist below the nozzle opening surface 23. Ink ejected in this manner passes through the endless belt 16*d* and is stored in the waste solution saucer 25. Incidentally, the printer 10 can be provided with a wiper or the like to clean the belt surface of the endless belt 16*d* that becomes dirty when ink ejected by the first flushing passes therethrough.

The second flushing is executed when a print process of a print target image is executed. The print control section 12*a* artificially generates flushing data that expresses a dot pattern for repeatedly ejecting flushing dots at prescribed distance intervals in pixel lines constituting a print target image that are in parallel with each other in the feed direction. Then, the print control section 12*a* superimposes (synthesizes) the flushing data and the print data that shows a print target image, and causes the printing head 20 to execute an ink ejection operation based on the superimposed ejection data. As a result of this, dots are formed on the paper P corresponding to each pixel in which dot on can be obtained by OR in the results of the superimposing. Therefore, clogging of the nozzles 22 can be prevented or solved at the same time when printing a print target image.

Figure 3:
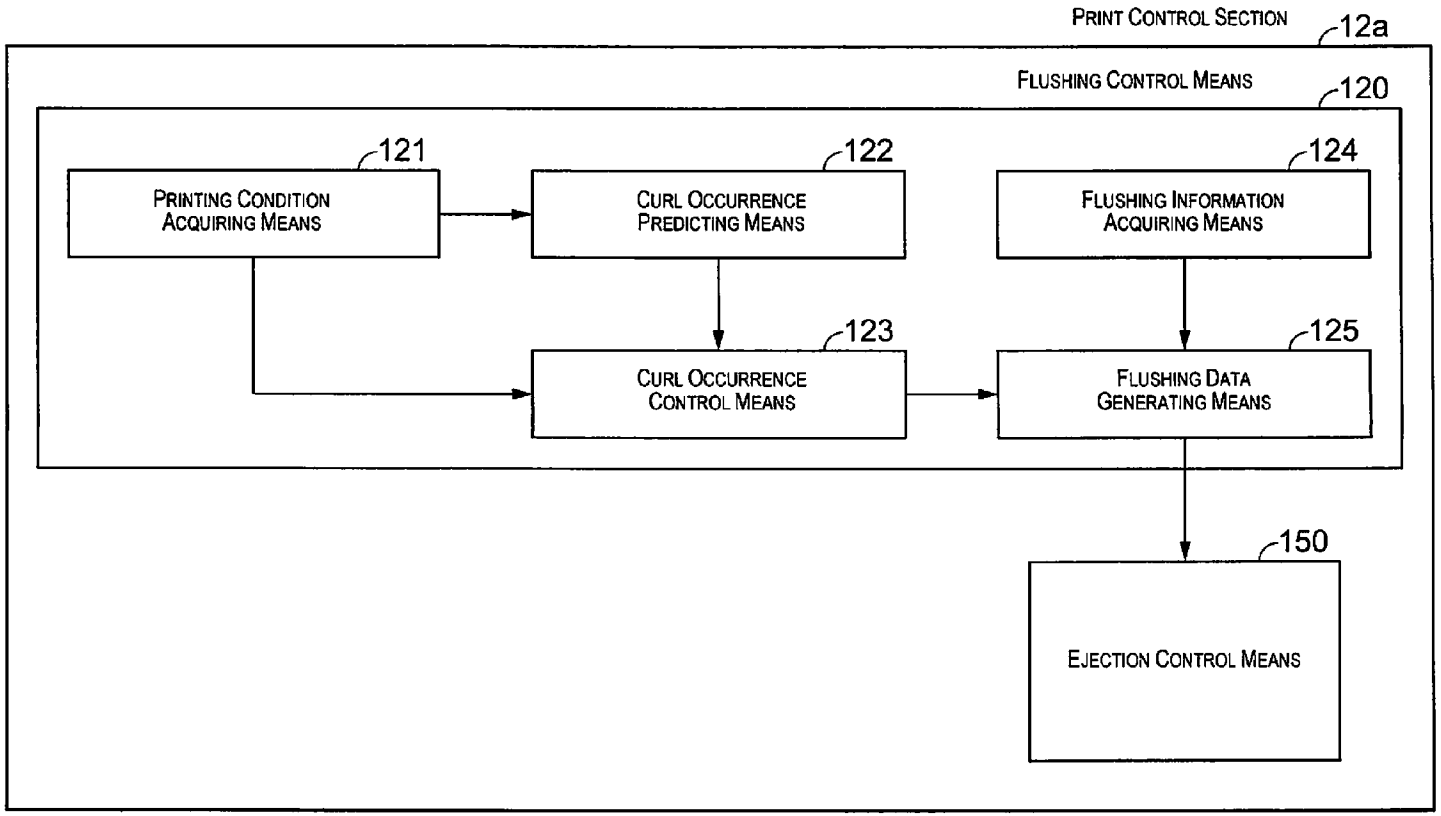
FIG. 3 is a diagram that shows a functional configuration of a print control section.

FIG. 3 shows a functional configuration of the print control section 12*a*. The print control section 12*a* has a flushing control means 120 and an ejection control means 150. The flushing control means 120 controls the second flushing, and has a printing condition acquiring means 121, a curl occurrence predicting means 122, a curl occurrence control means 123, a flushing information acquiring means 124, and a flushing data generating means 125. The printing condition acquiring means 121 acquires printing conditions input from the printer driver 41 or the operation panel 15, and extracts a prescribed parameter included in the acquired printing conditions. The prescribed parameter that has been extracted is transmitted to the curl occurrence predicting means 122 and the curl occurrence control means 123.

Figure 4:
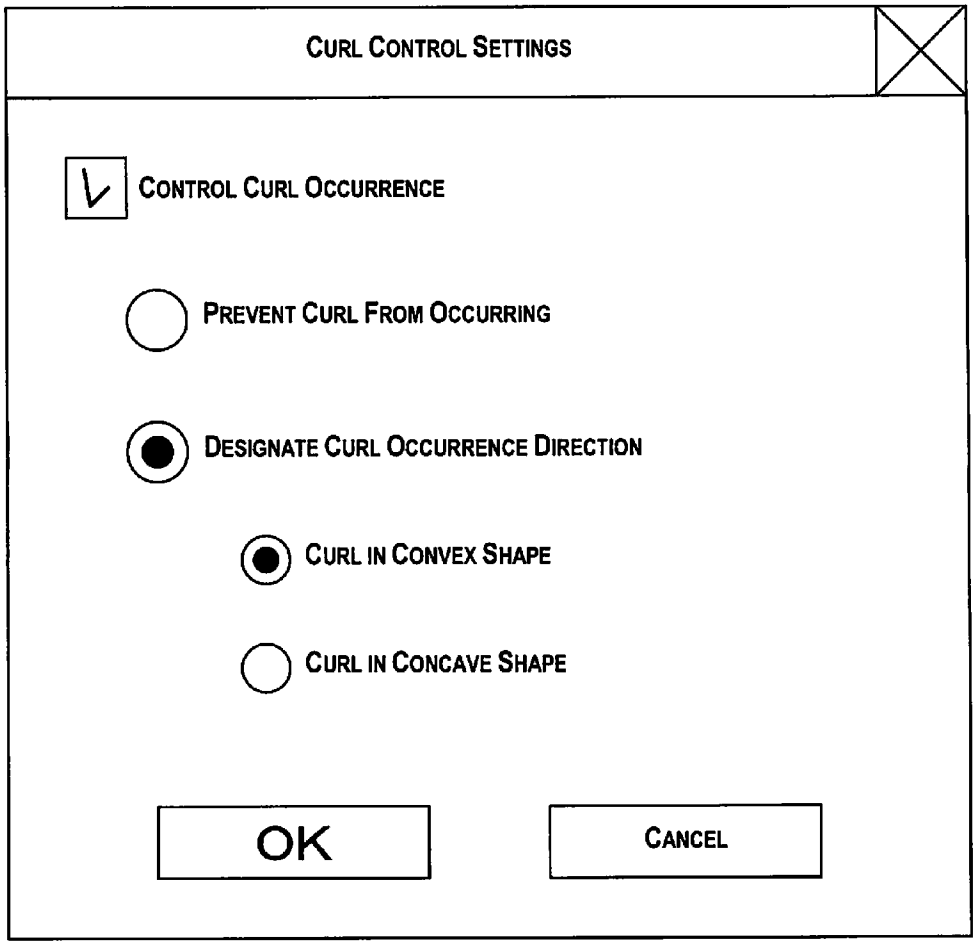
FIG. 4 is a diagram that shows an example of a UI screen acting as a setting screen.

In the present embodiment, the printing condition acquiring means 121 transmits a first parameter for conducting printing to the paper P so as to predict the occurrence or non-occurrence of a curl to the curl occurrence predicting means 122. Also, the printing condition acquiring means 121 transmits a second parameter that instructs the occurrence of a curl or a curl occurrence direction in the paper P to the curl occurrence control means 123. The second parameter transmitted to the curl occurrence control means 123 is set on a setting screen of the printer driver 41 in the PC 40 or a setting screen of the operation panel 15. FIG. 4 shows an example of a UI screen acting as a setting screen. A user calls up this UI screen and activates control of the occurrence of a curl, so as to explicitly instruct to control warpage due to a curl phenomenon in which warpage occurs in one direction caused by ink absorption of the paper P or to explicitly instruct a direction in which warpage occurs. In a case of instructing a direction in which warpage occurs, a user can issue instructions such that the direction of the warpage is either one of a convex shape or a concave shape. The printing condition acquiring means 121 acquires the second parameter determined on this UI screen and transmits it to the curl occurrence control means 123.

Back to FIG. 3, the curl occurrence predicting means 122 predicts the curl occurrence in the paper P based on the first parameter transmitted from the printing condition acquiring means 121. In the present embodiment, the first parameter can be a size of an image or the position on the paper P of a print target image to be printed on each of two surfaces of the paper P, the print resolution defined by the feed speed of feeding the paper P, the print mode such as color or monochrome, the paper quality of the paper P, or the like. The curl occurrence predicting means 122 calculates the ink amount (liquid amount) ejected onto each of two surfaces of the paper P or the ejection distribution state of ink that adheres to the paper P based on the first parameter, and predicts the occurrence of warpage in the paper P taking the kind of the ink or the paper quality into consideration. The information regarding the prediction results is transmitted to the curl occurrence control means 123.

Here, the control unit 11 can have a database that associates the first parameter with the curl occurrence frequency and can predict the curl occurrence by referring to this database. Alternatively, the control unit 11 can constitute an inference engine so as to make an inference from the first parameter. Another configuration is also possible in which a database or an inference engine is formed on the PC 40 or a cloud computer connected via a network, and the control unit 11 refers to the database or the inference engine. The curl occurrence control means 123 determines control to the occurrence of warpage in the paper P based on the information transmitted from the curl occurrence predicting means 122 and the second parameter transmitted from the printing condition acquiring means 121. For example, in a case in which the second parameter instructs control of the curl occurrence and the curl occurrence predicting means 122 predicts the occurrence of warpage due to a curl phenomenon, the curl occurrence control means 123 determines control of the curl occurrence and instructs the flushing data generating means 125 to generate flushing data that does not cause warpage.

In a case in which the second parameter designates a direction of the curl occurrence, the curl occurrence control means 123 determines that a curl will be caused and instructs the flushing data generating means 125 to generate flushing data so as to cause a curl in the designated direction in the paper P irrespective of the curl occurrence prediction by the curl occurrence predicting means 122. Here, in a case in which the curl occurrence predicting means 122 has not predicted the curl occurrence, a configuration in which the occurrence of warpage is not controlled in the paper P can be conceived. The flushing information acquiring means 124 acquires flushing information for generating flushing data so as to conduct the second flushing. In the present embodiment, the flushing information is stored in the ROM 14 or the like. The flushing information acquired by the flushing information acquiring means 124 is transmitted to the flushing data generating means 125.

The flushing data generating means 125 generates flushing data for conducting the second flushing based on the flushing information and the instructions to generate from the curl occurrence control means 123. Here, in a case in which flushing data is generated to be applied to the front surface of the paper P or in a case in which there are no instructions from the curl occurrence control means 123, standard flushing data is generated based on the flushing information. Standard flushing data is also generated in a case in which control of the curl occurrence is not activated on the UI screen of FIG. 4. On the other hand, in a case of generating flushing data to be applied to the back surface of the paper P and acquiring the instructions to generate from the curl occurrence control means 123, the flushing data generating means 125 generates unique flushing data in response to the acquired instructions to generate.

Figure 5:
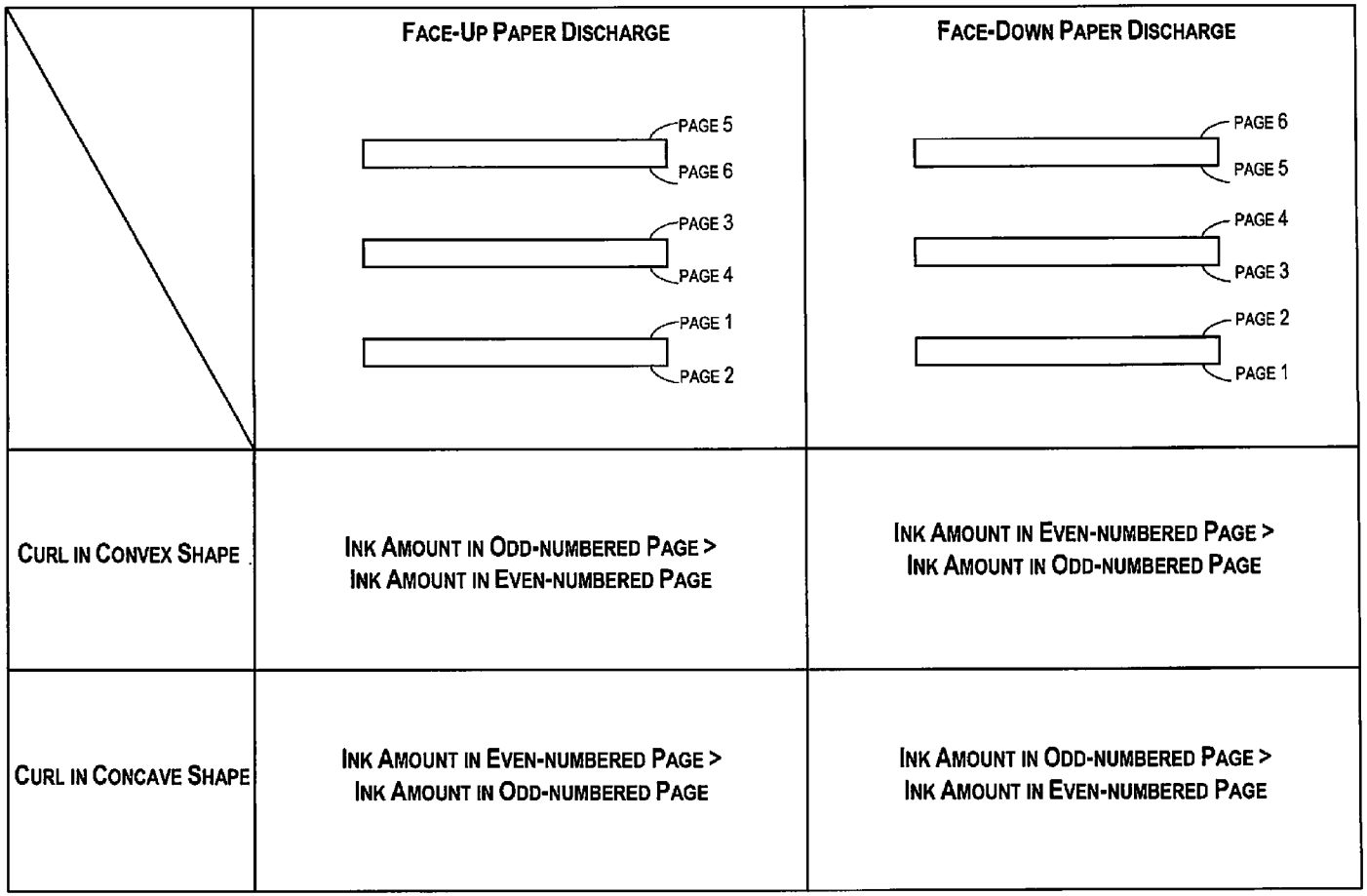
FIG. 5 is a diagram that shows a relationship between a paper discharge state and an ink amount corresponding to a direction of a curl.

For example, in a case in which generation of flushing data for controlling the occurrence of warpage is instructed, the flushing data generating means 125 calculates the ink amount ejected to each surface when executing printing on both surfaces of the paper P, and calculates an increment amount of ink to be ejected onto one of the surfaces of the paper P such that the difference in the ink amounts ejected onto the front surface and the back surface is equal to or less than a prescribed amount. Further, the flushing data generating means 125 determines a dot pattern for flushing to one of the surfaces of the paper P based on the positional relationship between a print target image on the front surface of the paper P and a print target image on the back surface of the paper P. Specifically, the flushing data generating means 125 generates flushing data (second ejection data) to one of the surfaces so as to create a unique dot pattern in which the increment amount is added to a prescribed ink amount ejected for a standard dot pattern. On the other hand, standard flushing data (first ejection data) for ejecting a prescribed ink amount is generated to the other surface of the paper P. Also, in a case in which double-sided printing is conducted over a plurality of pages and generation of flushing data that designates the warpage direction is instructed, the flushing data generating means 125 generates flushing data in accordance with the standard shown in the printing conditions of FIG. 5. As is well known, the paper P tends to rise in a direction toward a surface of the front surface and the back surface onto which a larger amount of ink is ejected. In the present embodiment, therefore, the direction in which warpage occurs is controlled using this tendency.

Specifically, in a case in which the paper P to which double-sided printing has been conducted is discharged by face-up paper discharge, when instructions that designate a convex-shaped curl as the warpage direction are issued, flushing data is generated so as to conduct ejection to the paper P such that the ink amount in an odd-numbered page is larger than the ink amount in an even-numbered page. When instructions that designate a concave-shaped curl as the warpage direction are issued, flushing data is generated so as to conduct ejection to the paper P such that the ink amount in an even-numbered page is larger than the ink amount in an odd-numbered page. On the other hand, in a case in which the paper P to which double-sided printing has been conducted is discharged by face-down paper discharge, when instructions that designate a convex-shaped curl as the warpage direction are issued, flushing data is generated so as to conduct ejection to the paper P such that the ink amount in an even-numbered page is larger than the ink amount in an odd-numbered page. When instructions that designate a concave-shaped curl as the warpage direction are issued, flushing data is generated so as to conduct ejection to the paper P such that the ink amount in an odd-numbered page is larger than the ink amount in an even-numbered page. Back to FIG. 3, flushing data generated by the flushing data generating means 125 is transmitted to the ejection control means 150.

Figure 6:
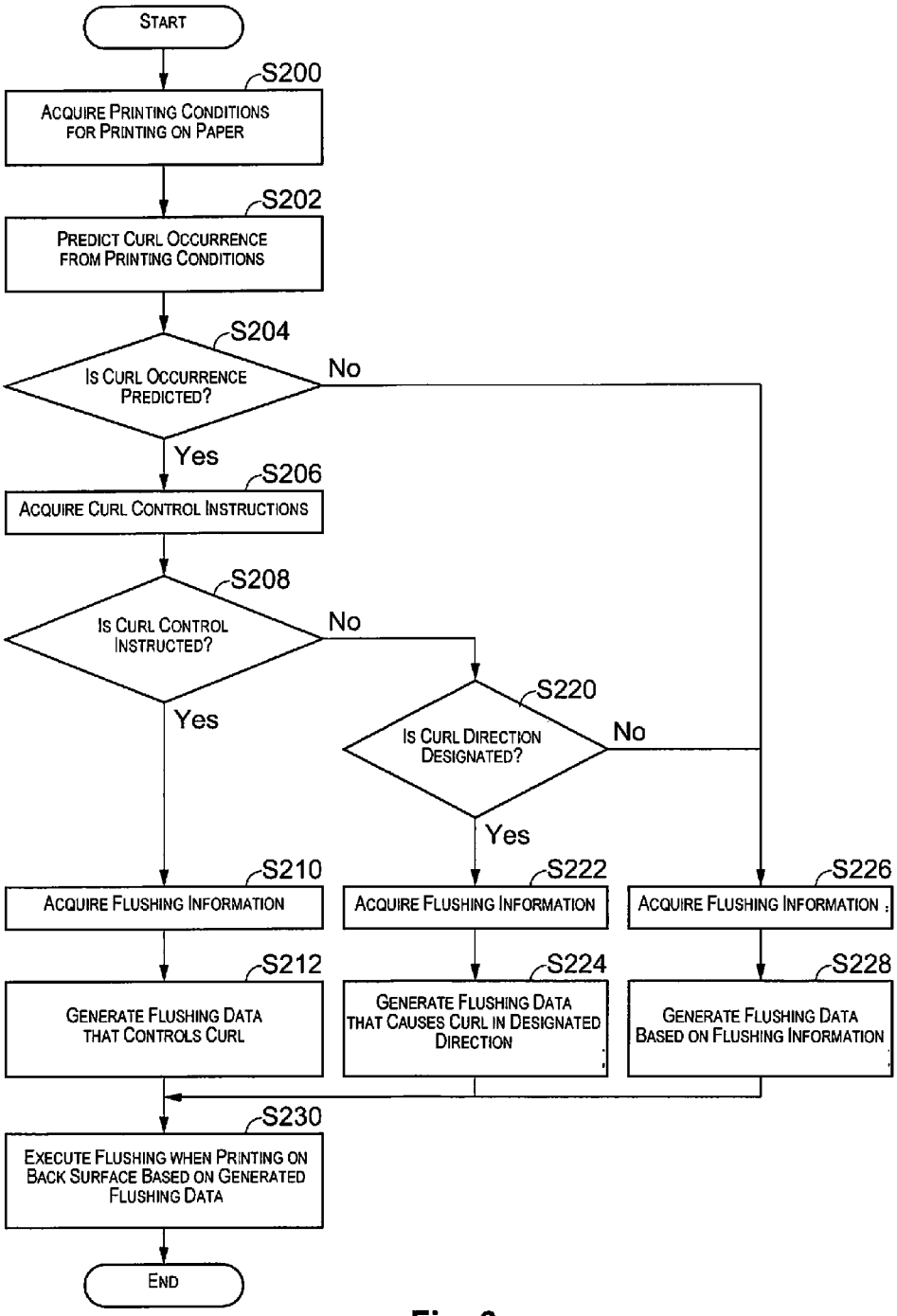
FIG. 6 is a flow chart that explains a flushing data generating process in double-sided printing.

The ejection control means 150 superimposes (synthesizes) the flushing data and the print data that shows a print target image, and causes the printing head 20 to execute ink ejection based on the superimposed data. By doing this, dots are formed on the paper P corresponding to each pixel in which dot on can be obtained by OR in the results of the superimposing. Therefore, clogging of the nozzles 22 can be prevented or solved at the same time when printing a print target image. Here, dots formed on the paper P corresponding to a pixel in which dot on is specified in either data when superimposing the flushing data and the print data that shows a print target image are both of the image forming dots and the flushing dots. FIG. 6 is a flow chart that explains a flushing data generating processing method (control method) in double-sided printing. When this process is started, the CPU 12 acquires the printing conditions for printing to the paper P (step S200).

Next, the CPU 12 predicts the occurrence of warpage (curl) due to a curl phenomenon in the paper P from the acquired printing conditions (step S202) <predicting step>. As a result of step S202, in a case in which the occurrence of a curl is not predicted (No in step S204), the process proceeds to step S226. On the other hand, in a case in which the occurrence of a curl is predicted (Yes in step S204), the CPU 12 acquires instructions regarding curl control (step S206) <curl occurrence control step>. As a result of the acquisition in step S206, in a case in which curl control is not instructed (No in step S208), the process proceeds to step S220. On the other hand, in a case in which curl control is instructed (Yes in step S208), the CPU 12 acquires the flushing information for generating the flushing data (step S210).

Subsequently, the CPU 12 generates the flushing data that controls the occurrence of a curl (step S212) <generating step>. Next, the CPU 12 executes the second flushing together with printing on the back surface of the paper P based on the generated flushing data (step S230), and finishes a series of processes. In step S220 that is executed in a case in which curl control is not instructed in step S208 (No in step S208), the CPU 12 judges whether the direction of causing a curl is designated or not (step S220). Here, in a case in which it is judged that the direction of causing a curl is designated (Yes in step S220), the CPU 12 acquires the flushing information for generating the flushing data (step S222).

Subsequently, the CPU 12 generates the flushing data that causes a curl in the designated direction (step S224), and proceeds to step S230. In step S204, in a case in which the occurrence of a curl is not predicted (No in step S204), or in step S220, in a case in which the direction of a curl is not designated (No in step S220), the CPU 12 acquires the flushing information for generating the flushing data (step S226). Subsequently, the CPU 12 generates the flushing data based on the flushing information (step S228), and proceeds to step S230.

According to the embodiment described above, the following effects are achieved.

(1) The direction of giving strength can be easily made uniform in the paper P that includes a plurality of sheets by generating the flushing data such that each of the plurality of sheets of the paper P are warped in a designated direction and then conducting the flushing.

(2) A curl phenomenon in which the paper P warps in one direction can be easily prevented from occurring by generating the flushing data that makes the ink amounts ejected onto both surfaces of the paper P substantially uniform irrespective of images printed on the paper P and then conducting the flushing.

(3) Since a curl occurring in the paper P can be controlled by using the flushing for controlling increase in the viscosity of ink, the occurrence of a curl phenomenon can be controlled at low cost without separately providing a functional section for controlling a curl.

A preferred embodiment was explained in the above with reference to the attached drawings. However, a preferred embodiment is not limited to this embodiment. It is apparent that the embodiment can be changed or modified without departing from the gist thereof, and the invention can also be implemented as follows.

MODIFIED EXAMPLE 1

In the above-described embodiment, a curl occurring in the paper P is controlled by using the flushing in which fine drops of ink are ejected onto the paper P. However, liquid for controlling a curl is not limited to ink. For example, in a case in which precoat liquid, that is a chemical solution for causing aggregation or deposit of a colorant component of each ink, is ejected onto the paper P, the occurrence of warpage due to a curl phenomenon can be controlled by controlling the ejected precoat amount or the ejection distribution. Also, a device for implementing the above-described technique includes various kinds of embodiments. There are cases in which it is achieved by a single device, and there are cases in which it is achieved by combining a plurality of devices. Each configuration of each embodiment and the combination thereof are examples, and changes such as addition, omission or replacement of the configuration can be made without departing from the subject matter of the invention. The invention is not limited to the embodiment, and is limited only to the scope of claims.

What is claimed is:

1. A printing device, comprising:

a head that has a plurality of nozzles;

a reversing section for reversing a front surface and a back surface that are facing surfaces of a printing medium facing the head; and a control section for causing the head to execute an ejection operation of forming an image forming dot for printing an image designated as a print target and a flushing dot other than the image forming dot on the facing surface by moving either one of the printing medium and the head so as to relatively change the positions of the printing medium and the head and ejecting liquid from each of the nozzles, wherein the control section calculates a liquid amount of the liquid ejected onto each of the two facing surfaces of the printing medium so as to form the image forming dot, predicts occurrence of warpage due to a curl phenomenon in which warpage of the printing medium occurs in one direction by absorbing the ejected liquid based on the liquid amount, and controls the ejection operation of forming the flushing dot such that a difference in the liquid amounts ejected onto the two facing surfaces is equal to or less than a prescribed amount.

2. The printing device according to claim 1, further comprising a determining means that determines whether occurrence of the warpage is to be controlled or not, wherein in a case in which the determining means determines that occurrence of the warpage is to be controlled, the control section determines the liquid amount ejected for the flushing dot onto at least one of the two facing surfaces.

3. The printing device according to claim 2, wherein the determining means has a direction determining means that determines a direction of causing the warpage in the printing medium in a case in which it is determined that occurrence of the warpage is not to be controlled, and the control section determines the liquid amount such that wapage occurs in the direction determined by the direction determining means.

4. The printing device according to claim 1, wherein the control section predicts occurrence of the warpage based on an ejection distribution state of the liquid, the kind of the liquid, or the kind of the printing medium in addition to the liquid amount ejected onto the printing medium.

5. The printing device according to claim 1, wherein the control section causes the flushing dot to be formed with a prescribed amount of the liquid amount and a prescribed dot pattern on one surface of the printing medium, and causes the flushing dot to be formed with the liquid amount and a dot pattern determined to control occurrence of the warpage on the other surface of the printing medium.

6. A printing device comprising:

a head that has a plurality of nozzles;

a reversing section for reversing a front surface and a back surface that are facing surfaces of a printing medium facing the head; and a control section for causing the head to execute an ejection operation of forming an image forming dot for printing an image designated as a print target and a flushing dot other than the image forming dot on the facing surface based on ejection data by moving either one of the printing medium and the head so as to relatively change the positions of the printing medium and the head and ejecting liquid from each of the nozzles, wherein the control section has a predicting means that calculates a liquid amount ejected onto each of the two facing surfaces of the printing medium so as to form the image forming dot and predicts occurrence of warpage due to a curl phenomenon in which warpage of the printing medium occurs in one direction by absorbing the ejected liquid based on the liquid amount, a curl occurrence control means that controls occurrence of the warpage predicted by the predicting means, and a generating means that generates the ejection data that forms the flushing dot for controlling occurrence of the warpage on at least one of the facing surfaces.

7. A method for controlling a printing device including a head that has a plurality of nozzles, a reversing section for reversing a front surface and a back surface that are facing surfaces of a printing medium facing the head, and a control section for causing the head to execute an ejection operation of forming an image forming dot for printing an image designated as a print target and a flushing dot other than the image forming dot on the facing surface based on ejection data by moving either one of the printing medium and the head so as to relatively change the positions of the printing medium and the head and ejecting liquid from each of the nozzles, the method comprising:

calculating a liquid amount ejected onto each of the two facing surfaces of the printing medium so as to form the image forming dot and predicting occurrence of warpage due to a curl phenomenon in which warpage of the printing medium occurs in one direction by absorbing the ejected liquid based on the liquid amount;

controlling occurrence of the warpage predicted; and generating the ejection data that forms the flushing dot for controlling occurrence of the warpage on at least one of the facing surfaces.

* * * * *